US007749008B2

(12) United States Patent
Klassen et al.

(10) Patent No.: US 7,749,008 B2
(45) Date of Patent: Jul. 6, 2010

(54) SUBMERSIBLE ELECTRICAL CABLE CONNECTOR

(75) Inventors: William P. Klassen, Davis, CA (US); A. Tyler Schilling, Davis, CA (US); Jeffery D. Kroll, Davis, CA (US); Stacy L. Wright, Davis, CA (US)

(73) Assignee: Schilling Robotics, Inc., Davis, CA (US)

( * ) Notice: Subject to any disclaimer, the term of this patent is extended or adjusted under 35 U.S.C. 154(b) by 26 days.

(21) Appl. No.: 12/196,103

(22) Filed: Aug. 21, 2008

(65) Prior Publication Data

US 2009/0068871 A1 Mar. 12, 2009

Related U.S. Application Data

(60) Provisional application No. 60/957,990, filed on Aug. 24, 2007.

(51) Int. Cl.
*H01R 4/64* (2006.01)

(52) U.S. Cl. ..... 439/201; 439/205; 439/22; 439/372

(58) Field of Classification Search ..... 439/21, 439/22, 199–201, 345, 352, 372, 936, 205–206
See application file for complete search history.

(56) References Cited

U.S. PATENT DOCUMENTS

| | | | | |
|---|---|---|---|---|
| 3,784,959 | A | 1/1974 | Horton | |
| 3,997,230 | A | 12/1976 | Secretan | |
| 4,699,591 | A * | 10/1987 | Gallo et al. | 439/21 |
| 4,722,695 | A | 2/1988 | Zwicker et al. | |
| 4,932,882 | A * | 6/1990 | Kang | 439/22 |
| 5,037,322 | A | 8/1991 | Adams et al. | |
| 5,704,792 | A | 1/1998 | Sobhani | |
| 5,885,108 | A | 3/1999 | Gerrans | |
| 5,888,083 | A | 3/1999 | Seilhan et al. | |
| 5,993,272 | A | 11/1999 | Wood et al. | |
| 6,009,950 | A | 1/2000 | Cunningham et al. | |
| 6,020,276 | A | 2/2000 | Hoyes et al. | |
| 6,223,675 | B1 | 5/2001 | Watt et al. | |
| 6,719,578 | B1 | 4/2004 | Klassen et al. | |
| 2003/0194176 | A1 | 10/2003 | Townsend et al. | |
| 2007/0243739 | A1 | 10/2007 | Cairns et al. | |

FOREIGN PATENT DOCUMENTS

| | | |
|---|---|---|
| FR | 2584874 | 1/1987 |

* cited by examiner

*Primary Examiner*—Khiem Nguyen
(74) *Attorney, Agent, or Firm*—Sheppard, Mullin, Richter & Hampton LLP

(57) ABSTRACT

The present invention is embodied in a submersible electrical cable connector having a cable-side connector assembly and a receptacle-side connector assembly. In a preferred embodiment, the cable-side connector assembly includes a generally circular printed circuit board having individual pin assemblies, each pin assembly having its own spring-loaded mechanism. The pin assemblies provide for an electrical connection between the cable-side connector assembly and the receptacle-side connector assembly. The printed circuit board also includes an oil valve that allows oil to flow between the cable-side connector assembly and the receptacle-side connector assembly when the two connector assemblies are coupled together. The cable-side connector assembly additionally includes a cap having a bleed valve that allows a user to remove air trapped within the submersible electrical cable connector when it is filled with oil.

29 Claims, 9 Drawing Sheets

SUBMERSIBLE ELECTRICAL CABLE CONNECTOR

CROSS-REFERENCE TO RELATED APPLICATION

Priority is claimed to U.S. Provisional Application Ser. No. 60/957,990, filed on Aug. 24, 2007, the contents of which are incorporated by reference in their entirety.

FIELD OF THE INVENTION

The present invention relates generally to electrical cable connectors. More particularly, the invention relates to electrical cable connectors that are suitable for use underwater.

BACKGROUND OF THE INVENTION

There is an increasing demand for reliable submersible electrical cable connectors for use in oceanic military applications, including submarines and other submersible vehicles, in underwater research and exploration applications, in ocean mining applications, and in offshore oil drilling applications. In designing submersible electrical cable connectors, several factors must be considered.

One factor that must be considered in designing a submersible electrical cable connector is the connector's ability to withstand increasingly high pressures as underwater depth levels increase. High pressures can crush or otherwise deform electrical cable connectors that are not properly designed to withstand such pressures. One way to overcome the effect of high pressures is to equalize the pressure by filling the connector with a pressure equalizing fluid, such as oil. Pressure equalization minimizes the effects of the water pressure on the connector. It is important that the oil be used once the connector is in actual use and that the oil be easily introduced into and removed from the connector. One way to do this is disclosed in U.S. Pat. No. 6,719,578 to Klassen et al. The connector disclosed in the preferred embodiments of that patent, however, relies upon a single wave spring both to introduce oil throughout the connector and to establish a valid electrical connection. This single-spring design has disadvantages concerning long-term reliability.

A second factor to be considered is the ease in establishing a valid and efficient connection and the ability to maintain that connection under increased pressures. Most submersible connectors use a pin/socket assembly found in conventional land-based electrical cable connectors. The pin/socket assembly is usually encased and sealed and may be surrounded by oil in order to prevent deformities resulting from high water pressures. One such connector is disclosed in U.S. Pat. No. 5,888,083 to Seilhan et al. As shown in FIG. 4 of that patent, the connector relies upon a traditional pin/socket assembly requiring that the pins be aligned with the holes in the socket for a valid connection to be established.

One disadvantage of this type of arrangement is that it is often difficult to align the traditional pin/socket assembly, as the pins and socket require exact angular alignment. Moreover, under increasing pressures, the pins in a traditional pin/socket assembly may become distorted or misaligned, making a valid connection difficult or impossible.

One way to avoid these disadvantages is disclosed in U.S. Pat. No. 6,719,578 to Klassen et al. This patent discloses a submersible electrical cable connector having a cable-side connector assembly and a receptacle-side connector assembly. The cable-side connector assembly has a flex circuit comprising a circular head having a plurality of pins arranged in a symmetrically shaped configuration. The receptacle-side connector assembly has a molded contact conductor comprising a number of concentric conductive rings with insulating material positioned between each ring. Each concentric conductive ring makes a physical and electrical connection with at least one of the pins when the cable-side connector assembly and the receptacle-side connector assembly are coupled together. The connector included in the preferred embodiments of that patent, however, relies upon a single wave spring both to introduce oil throughout the connector and to establish a valid electrical connection for each of the pins. This single-spring design has disadvantages concerning long-term reliability.

Accordingly, it is desired to have a submersible connector that is easy to connect, maintains its connectivity after extensive use underwater, and avoids the disadvantages of the prior art connectors discussed above. The present invention satisfies this need.

SUMMARY OF THE INVENTION

The present invention is embodied in a submersible electrical cable connector having a cable-side connector assembly and a receptacle-side connector assembly. In a preferred embodiment, the cable-side connector assembly includes a generally circular printed circuit board having individual and unique pin assemblies, each pin assembly having its own spring-loaded mechanism. The pin assemblies provide for an electrical connection between the cable-side connector assembly and the receptacle-side connector assembly. The printed circuit board also includes an oil valve that allows oil to flow between the cable-side connector assembly and the receptacle-side connector assembly when the two connector assemblies are coupled together.

The cable-side connector assembly is comprised of two main elements. The first main element of the cable-side connector assembly comprises a plastic housing having a recess in which the printed circuit board is located. The housing includes a generally tubular protrusion through which electrical conductors pass and oil flows into the cable-side connector assembly. The second main element of the cable-side connector assembly comprises a plastic cap that covers the top of the recess in which the printed circuit board is located. This cap includes a bleed valve that allows a user to remove air trapped within the submersible electrical cable connector when it is filled with oil.

Located between the housing and cap is a rubberized sealing ring that provides a watertight seal, protecting the internal elements of the submersible electrical cable connector as it is submersed. The housing and cap are held fixedly together by a plurality of screws.

The receptacle-side connector assembly includes a contact receptor having a plurality of concentric conducting rings. Insulating material is positioned between each conducting ring. Each concentric conducting ring makes a physical and electrical connection with at least one of the spring-loaded pin assemblies when the cable-side connector assembly and the receptacle-side connector assembly are coupled together. The contact receptor also makes a physical connection with the oil valve.

When the submersible electrical cable connector of the present invention is fully assembled, the cable-side connector assembly will fit onto the receptacle-side connector assembly using a lever-actuated latch assembly, without the need for any angular alignment of the cable-side connector assembly and receptacle-side connector assembly. The lever-actuated latch assembly ensures a proper electrical connection regardless of the angular orientations of the two connector assemblies.

Thus, in one embodiment, the present invention is embodied in a submersible cable connector assembly comprising a cable-side connector assembly and a receptacle-side connector assembly. The cable-side connector assembly comprises a printed circuit board having a plurality of pin assemblies protruding therefrom. The receptacle-side connector assembly comprises a contact receptor having a plurality of concentric conducting rings with insulating material positioned between each ring. Each of the plurality of pin assemblies comprises a spring and an associated pin. Each pin assembly spring is configured to apply an outward force to its associated pin and urge the associated pin to make contact with one of the plurality of concentric conducting rings when the cable-side connector assembly and the receptacle-side connector assembly are coupled together.

In one embodiment, the contact receptor is configured to apply an inward force to the pins of the plurality of pin assemblies and force each pin assembly spring to compress when the cable-side connector assembly and the receptacle-side connector assembly are coupled together. The cable-side connector assembly and the receptacle-side connector assembly are configured to be coupled together to create an electrical connection regardless of how the cable-side connector assembly and the receptacle-side connector assembly are angularly oriented. A sealing ring is located within the cable-side connector assembly and configured to provide a watertight seal between the cable-side connector assembly and the receptacle-side connector assembly when the cable-side connector assembly and the receptacle-side connector assembly are coupled together.

In one embodiment, the printed circuit board further comprises an oil valve configured to allow oil to flow between the cable-side connector assembly and the receptacle-side connector assembly when the cable-side connector assembly and the receptacle-side connector assembly are coupled together. The oil valve comprises a valve sealing ring and a ring holder positioned on an upper side of the printed circuit board, a valve spring and a contact head positioned on a lower side of the printed circuit board, and a shaft extending through a hole in the printed circuit board and connecting the ring holder to the contact head. The ring holder comprises an upper rim and a lower rim holding the valve sealing ring. The valve spring is configured to force the oil valve into a closed position in which the valve sealing ring is pressed against the printed circuit board, thereby inhibiting oil from flowing through the hole in the printed circuit board, when the cable-side connector assembly and the receptacle-side connector assembly are not coupled together. The contact receptor is configured to force the oil valve into an open position in which the valve sealing ring is moved away from the printed circuit board, thereby allowing oil to flow though the hole in the printed circuit board, when the cable-side connector assembly and the receptacle-side connector assembly are coupled together.

In one embodiment, the cable-side connector assembly further comprises a housing defining a recess in which the printed circuit board is located, a cap covering the recess, and a sealing ring positioned between the housing and the cap and configured to provide a watertight seal between the housing and the cap. The housing includes a plurality of holes, each hole configured to allow one of the plurality of pin assemblies to extend therethrough. The housing also has a tubular protrusion configured to allow oil and a cable to pass into the housing. The cap comprises a bleed valve configured to allow the removal of air trapped within the submersible cable connector assembly when the submersible cable connector assembly is filled with oil. The bleed valve comprises a countersunk screw and an air chamber located in the cap and configured to receive the countersunk screw. The countersunk screw comprises a socket head. Air trapped within the submersible cable connector assembly can be removed by unscrewing the countersunk screw.

In one embodiment, a latch assembly is attached to the cable-side connector assembly and configured to force the cable-side connector assembly and the receptacle-side connector assembly together to create an electrical connection. The latch assembly comprises a latch having a fly grip and a lever configured to pivot on the cable-side connector assembly and actuate the latch. The fly grip is configured to apply a force to the receptacle-side connector assembly as the lever is pivoted from an unlatched position in which the lever extends outward from the cable-side connector assembly to a latched position in which the lever is flush with the cable-side connector assembly. The force applied by the fly grip to the receptacle-side connector assembly causes the cable-side connector assembly and receptacle-side connector assembly to be pulled together, creating an electrical connection between the cable-side connector assembly and the receptacle-side connector assembly.

In one embodiment, the cable-side connector assembly further comprises a housing defining a pair of flanges and a rod having a right end attached to one of the pair of flanges and a left end attached to the other one of the pair of flanges, the rod configured to inhibit the latch from flexing outward from the housing when the lever is in the latched position. The latch further has an indentation configured to receive the rod and allow the latch to flex outward from the housing when the lever is in the unlatched position.

Other features and advantages of the present invention should become apparent from the following description of the preferred embodiments, taken in conjunction with the accompanying drawings, which illustrate, by way of example, the principles of the invention.

DETAILED DESCRIPTION OF THE PREFERRED EMBODIMENTS

Figure 1:
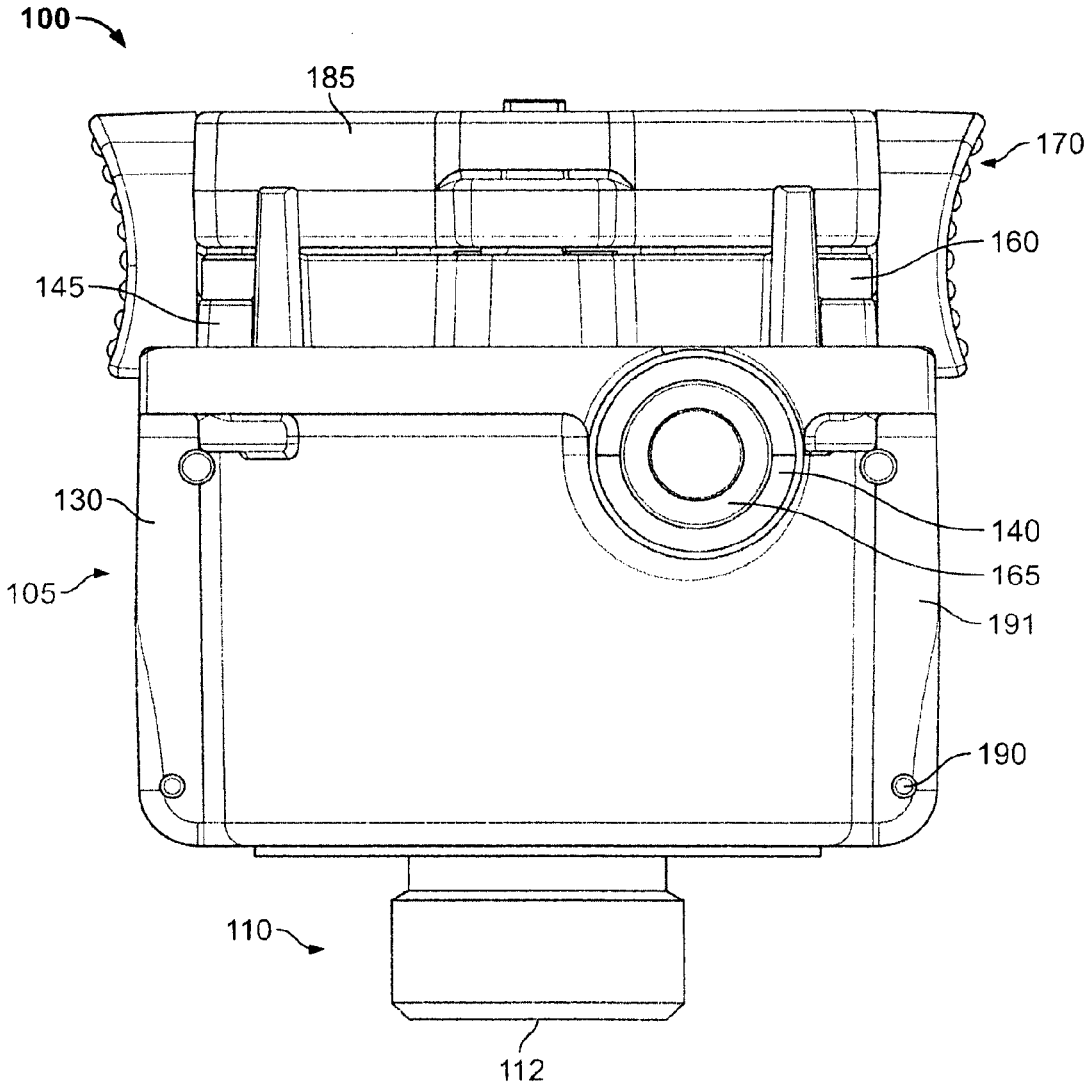
FIG. 1 is a front elevational view of a preferred embodiment of the submersible electrical cable connector of the present invention, showing the submersible electrical cable connector in a latched position.
Figure 2:
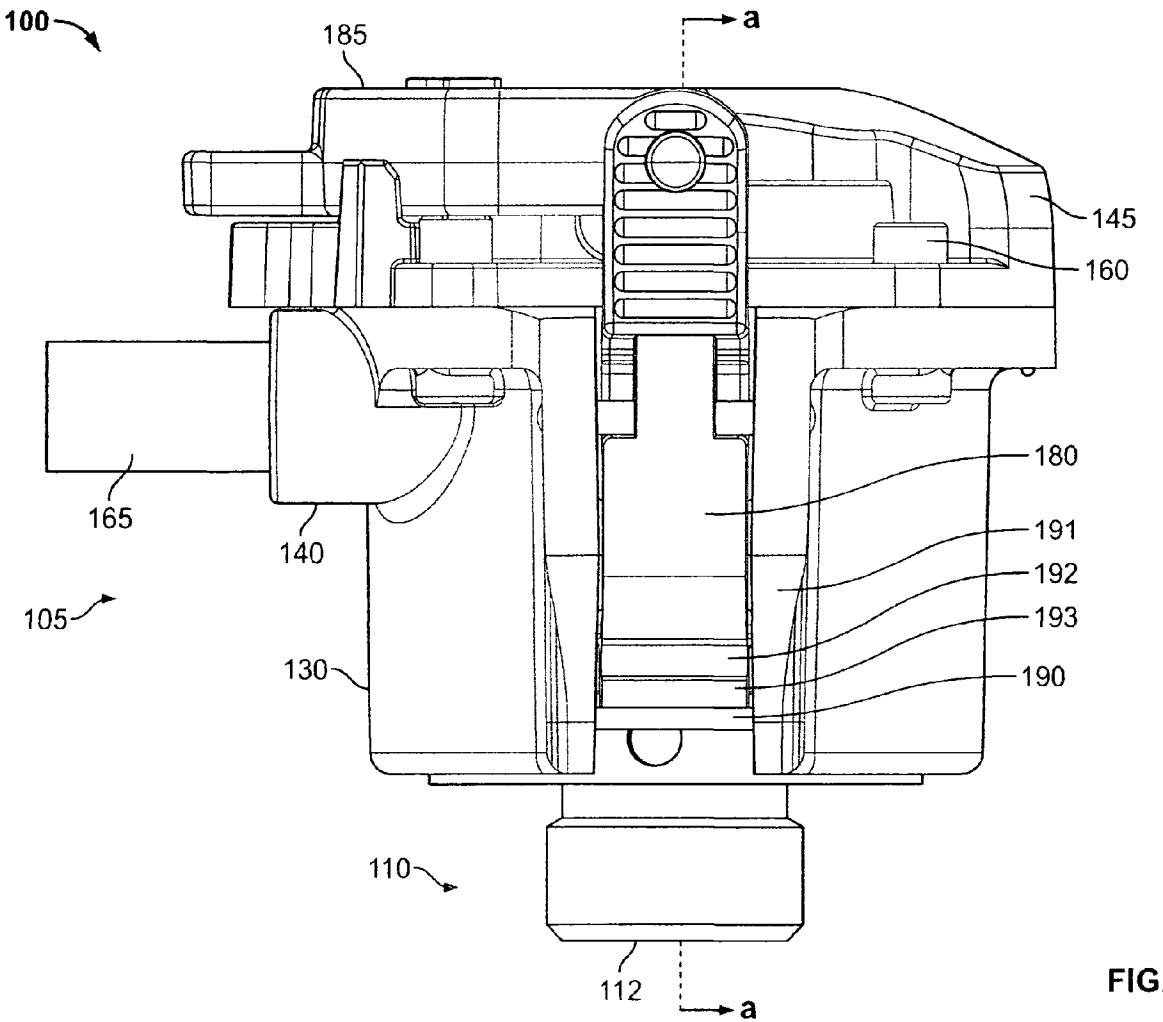
FIG. 2 is a side elevational view of the preferred embodiment of FIG. 1, showing the submersible electrical cable connector in its latched position.
Figure 3:
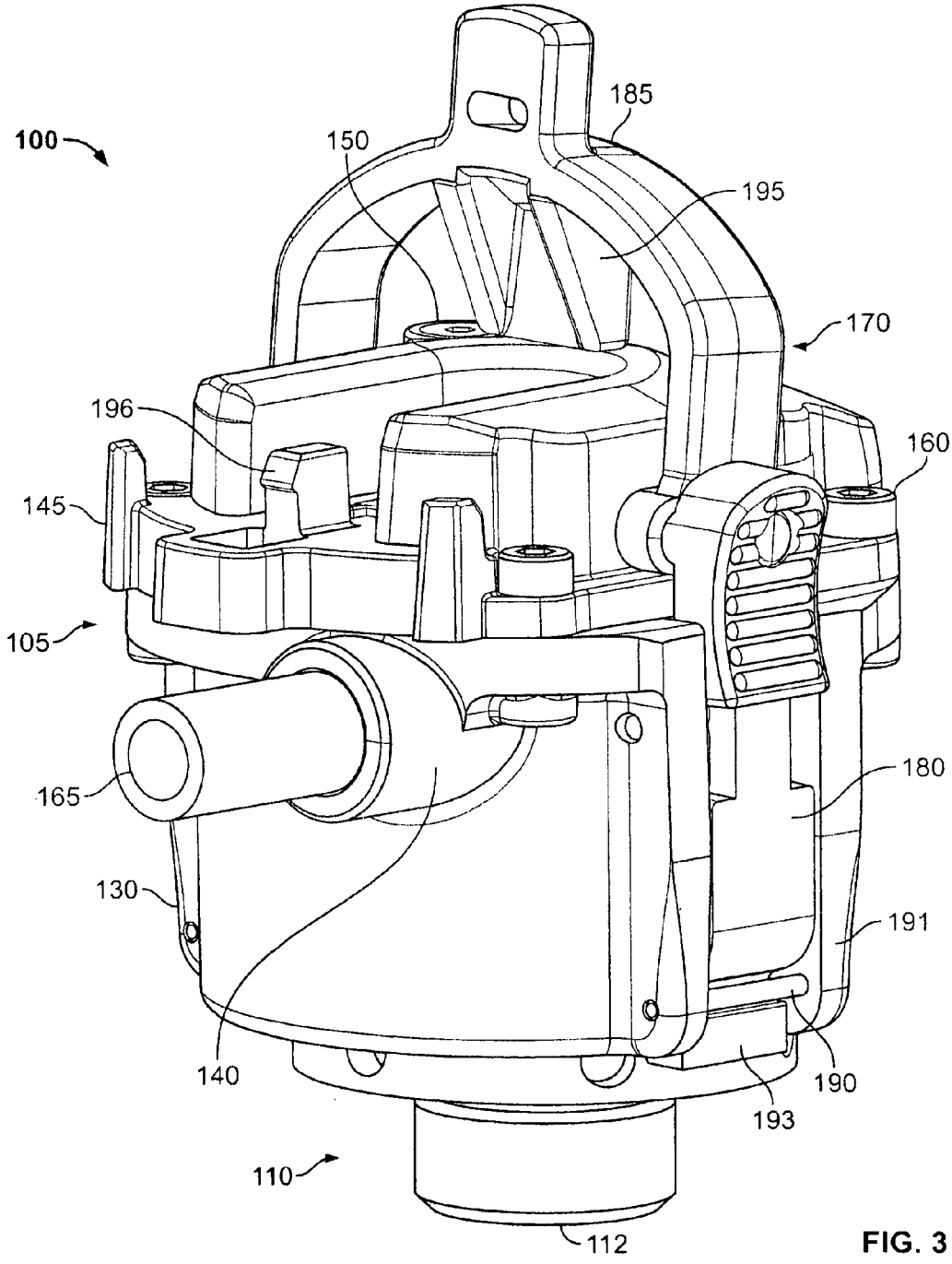
FIG. 3 is a perspective view of the preferred embodiment of FIG. 1, showing the submersible electrical cable connector in an unlatched position.
Figure 4:
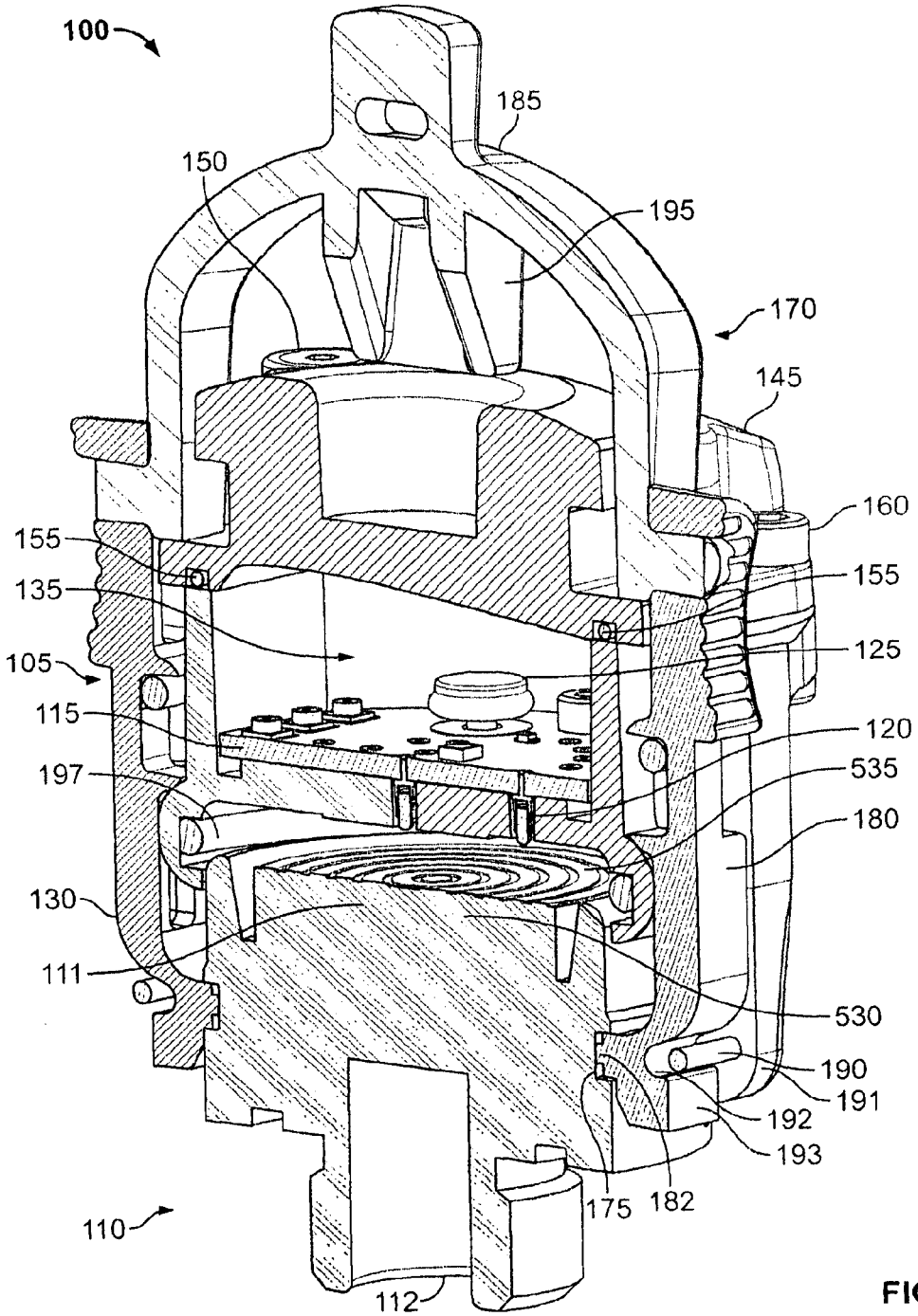
FIG. 4 is a sectional view of the preferred embodiment of FIG. 1, taken along the line a-a in FIG. 2, showing the submersible cable connector in its unlatched position.
Figure 5:
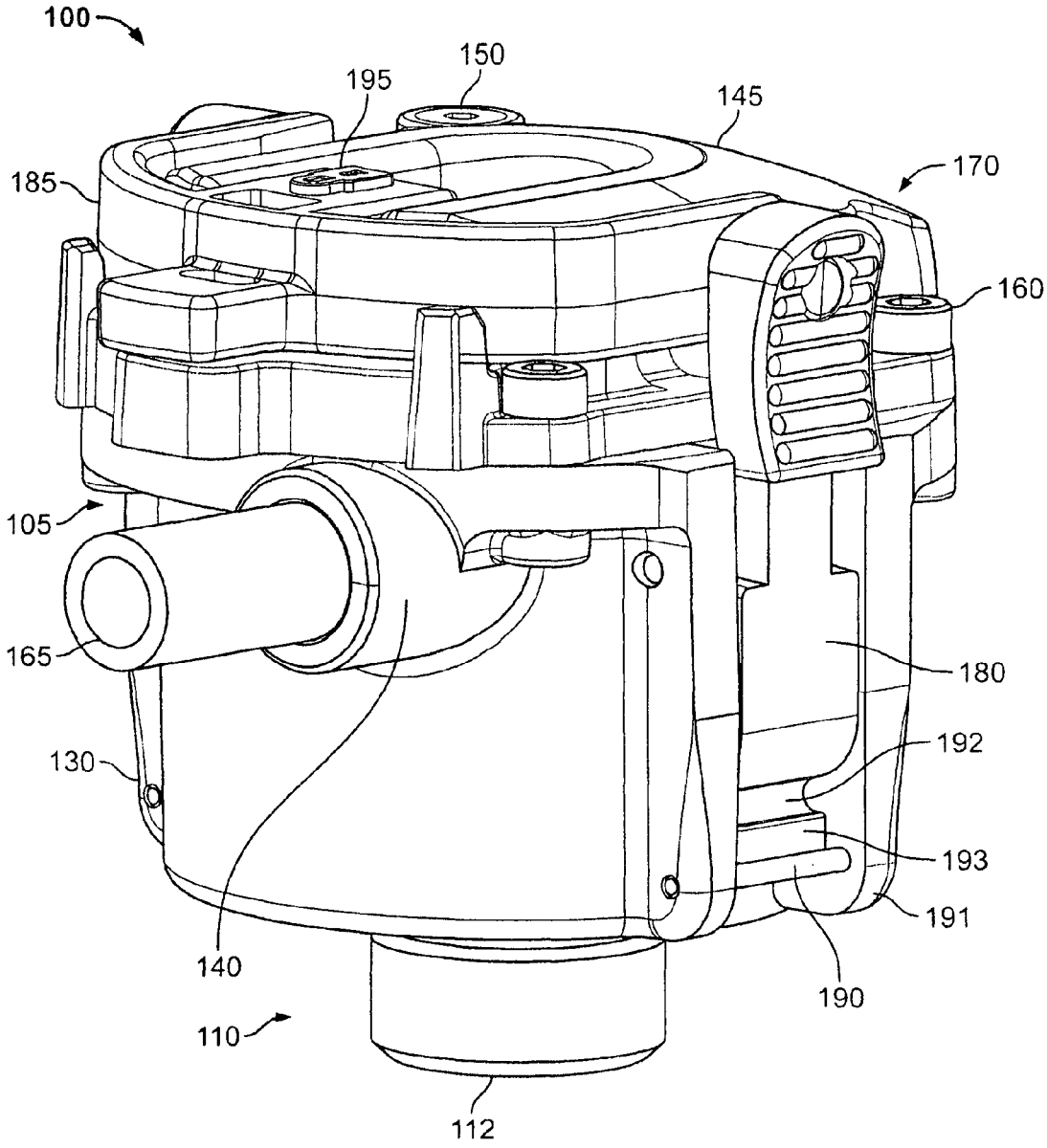
FIG. 5 is a perspective view of the preferred embodiment of FIG. 1, showing the submersible electrical cable connector in its latched position.
Figure 6:
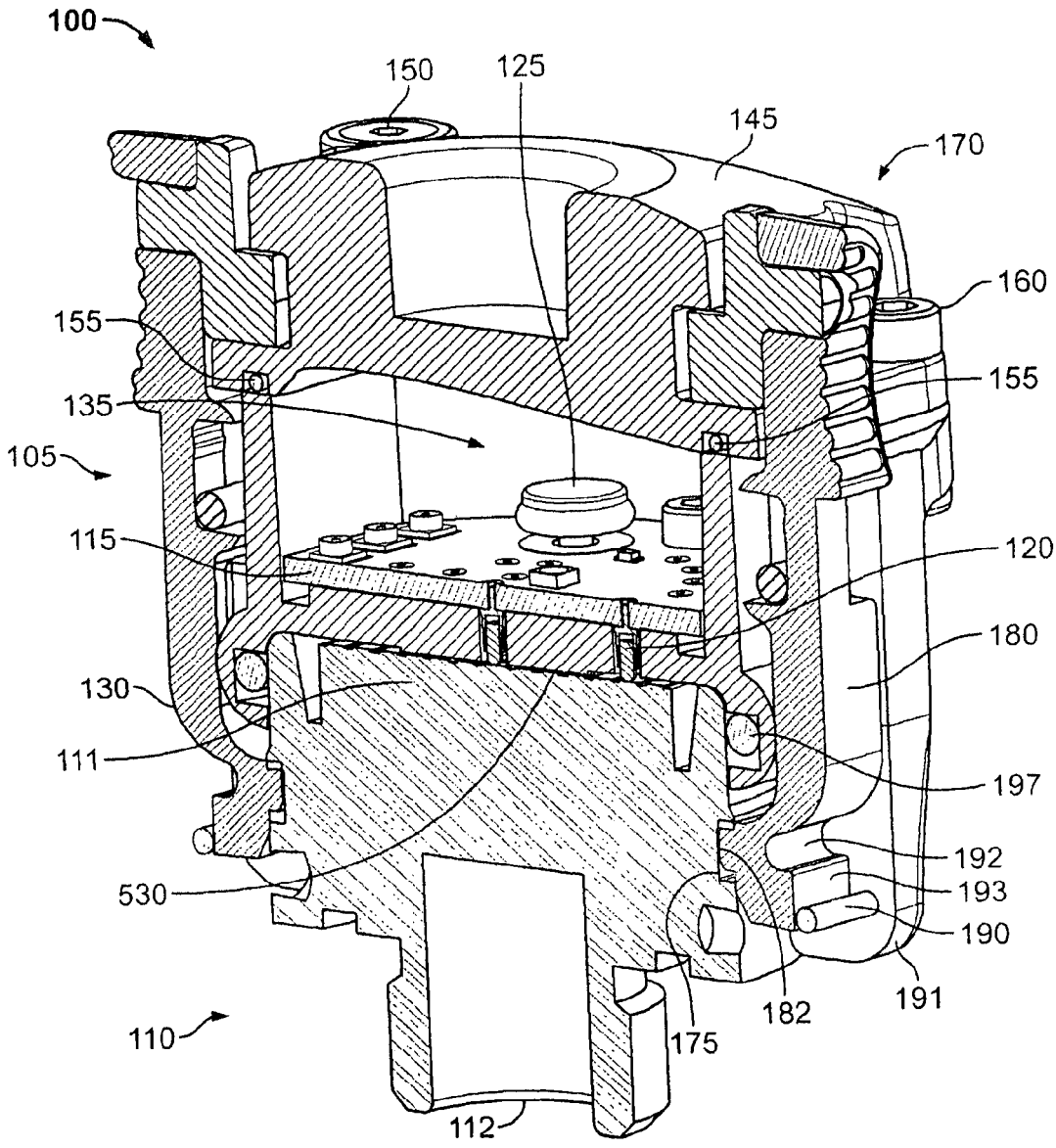
FIG. 6 is a sectional view of the preferred embodiment of FIG. 1, taken along the line a-a in FIG. 2, showing the submersible cable connector in its latched position.

FIGS. 1-6 show a preferred embodiment of the submersible electrical cable connector 100 of the present invention. The submersible electrical cable connector 100 includes a cable-side connector assembly 105 that receives the cable/wires (not shown) that are to be coupled to an underwater device or module. The cable-side connector assembly 105 is coupled to a receptacle-side connector assembly 110. The receptacle-side connector assembly 110 is attached to the underwater device or module to which the cable/wires are to be coupled. The submersible electrical cable connector 100 is designed for underwater use in research and exploration, ocean mining, offshore drilling, and other applications. Preferably, it can be used at underwater depths of up to about 6500 meters.

The cable side connector assembly 105 includes a generally circular printed circuit board 115 having a plurality of individual pin assemblies 120, each pin assembly 120 having its own spring-loaded mechanism. The pin assemblies 120 provide for an electrical connection between the cable-side connector assembly 105 and the receptacle-side connector assembly 110. The printed circuit board 115 also includes an oil valve 125 that allows oil (not shown) to flow between the cable-side connector assembly 105 and the receptacle-side connector assembly 110 when the two connector assemblies are coupled together.

The cable-side connector assembly 105 is comprised of two main elements. The first main element of the cable-side connector assembly 105 comprises a generally cylindrical, plastic housing 130 having a recess 135 in which the printed circuit board 115 is located. In a preferred embodiment, the housing 130 is comprised of an ISOPLAST™ engineering thermoplastic polyurethane resin. The housing 130 includes a generally tubular protrusion 140 through which a generally cylindrical tube 165 passes, carrying the cable/wires and oil into the cable-side connector assembly 105. The second main element of the cable-side connector assembly 105 comprises a plastic cap 145 that covers the top of the recess 135 in which the printed circuit board 115 is located. In a preferred embodiment, the cap 145 is comprised of an ISOPLAST™ engineering thermoplastic polyurethane resin. The cap 145 includes a bleed valve 150 that allows a user to remove air trapped within the submersible electrical cable connector 100 when it is filled with oil.

Located between the housing 130 and cap 145 is a rubberized sealing ring 155 that provides a watertight seal, protecting the internal elements of the submersible electrical cable connector 100 as it is submersed. The housing 130 and cap 145 are held fixedly together by a plurality of screws 160.

The receptacle-side connector assembly 110 has an actuator end 111 that couples to the cable-side connector assembly 105 to form the complete submersible electrical cable connector 100 of the present invention. The receptacle-side connector assembly 110 also has a conductive receptor end 112 that extends into the interior of the underwater device or module, and couples with wires or electrical traces (not shown) resident within the underwater device or module.

The receptacle-side connector assembly 110 additionally includes a molded contact receptor 530 having a plurality of concentric conducting rings 535. Insulating material is positioned between each conducting ring 535. Each concentric conducting ring 535 makes a physical and electrical connection with at least one of the spring-loaded pin assemblies 120 when the cable-side connector assembly 105 and the receptacle-side connector assembly 110 are coupled together. The molded contact receptor 530 also makes a physical connection with the oil valve 125. In other embodiments, the contact receptor 530 may be machined instead of molded.

Figure 7:
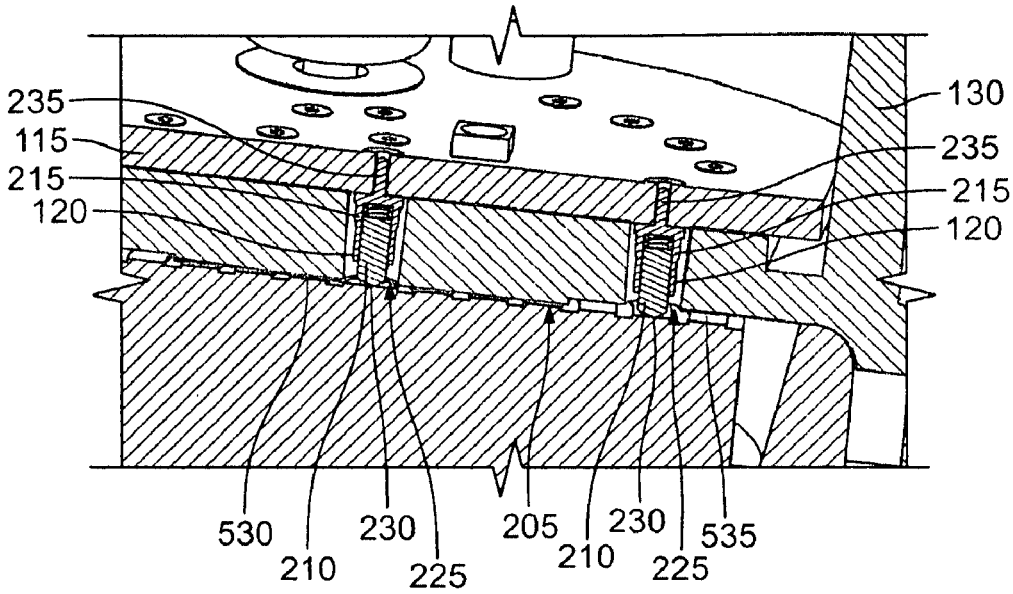
FIG. 7 is a detailed sectional view of the preferred embodiment of FIG. 1, showing two of the pin assemblies of the submersible electrical cable connector.

With reference to FIG. 7, there is shown a detailed view of the printed circuit board 115 and pin assemblies 120. In a preferred embodiment, each pin assembly 120 is attached to the printed circuit board 115 and is connected to electrical conductors within the circuit board 115. The pin assemblies 120 protrude from one side of the printed circuit board 115 and extend through generally cylindrical holes 225 in the bottom 205 of the housing 130 of the cable-side connector assembly 105.

Each of the pin assemblies 120 comprises a conducting pin 210, a pin holder 215, and a spring 220. The conducting pins 210 are generally cylindrical in shape and have a rounded bottom edge 230. The pin holders 215 are also generally cylindrical in shape and have a protrusion 235 that extends into the printed circuit board 115. Each spring 220 applies an outward force to its associated pin 210. When the cable-side connector assembly 105 and receptacle-side connector 110 assembly are coupled together, the molded contact receptor 530 pushes against the pins 210, applying an inward force to the pins 210 and forcing the pin assemblies 120 to compress. The springs 220 maintain their outward force on the pins 210, ensuring that the pins 210 maintain their electrical connection to the molded contact receptor 530. In a preferred embodiment, there are two conducting pins 210 for each conducting ring 535, with the exception of the innermost conducting ring 535, for which there is only one conducting pin 210.

Figure 8:
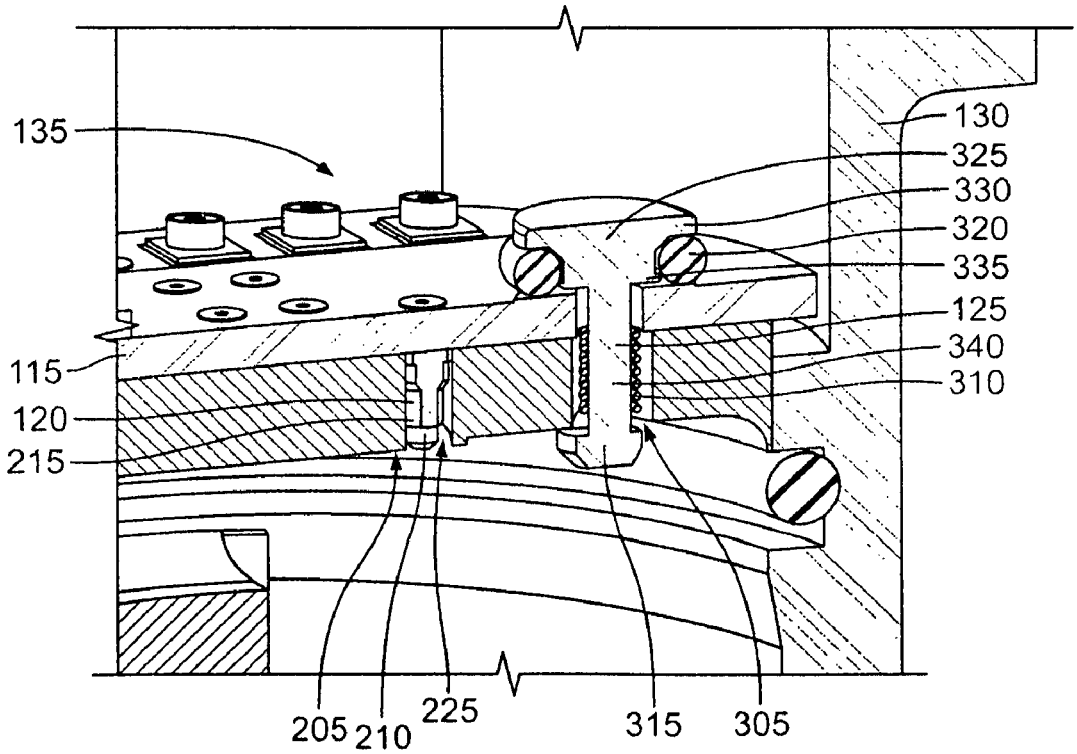
FIG. 8 is a detailed sectional view of the preferred embodiment of FIG. 1, showing the oil valve of the submersible electrical cable connector in a closed position.
Figure 9:
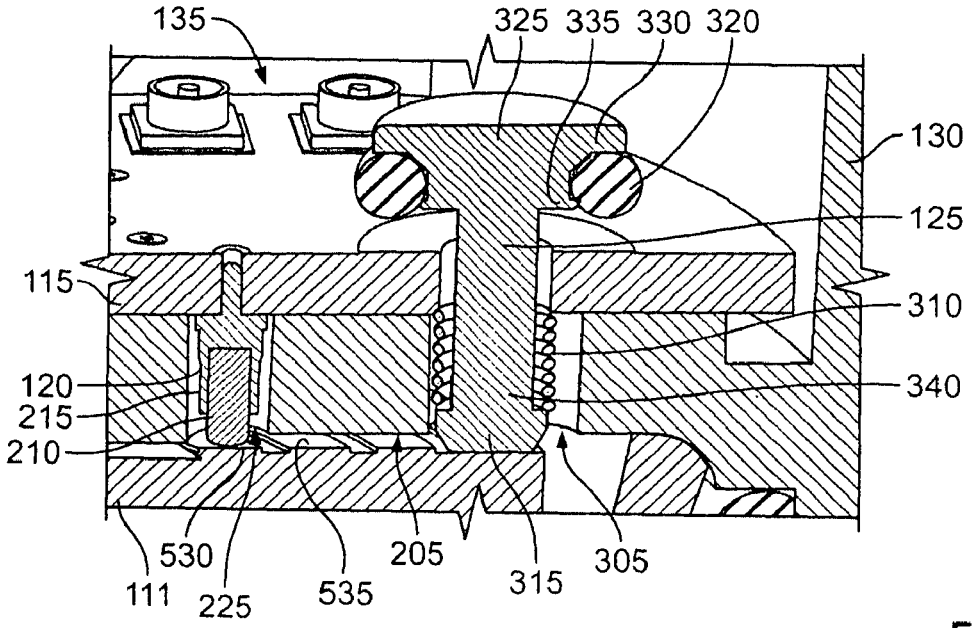
FIG. 9 is a detailed sectional view of the preferred embodiment of FIG. 1, showing the oil valve of the submersible electrical cable connector in an open position.

With reference to FIGS. 8 and 9, there is shown two detailed views of the oil valve 125. The oil valve 125 extends through a hole 305 in the printed circuit board 115 and bottom 205 of the housing 130. The oil valve 125 protrudes from both sides of the circuit board 115. The oil valve 125 has a spring 310 and contact head 315 on one side of the printed circuit board 115, and a rubberized sealing ring 320 and ring holder 325 on the opposite side of the circuit board 115. The ring holder 325 has an upper rim 330 and a lower rim 335 that keep the rubberized sealing ring 320 in position relative to the oil valve 125. A generally cylindrical shaft 340 connects the contact head 315 and ring holder 325.

As shown in FIG. 8, when the cable-side connector assembly 105 and receptacle-side connector assembly 110 are not coupled together, the spring 310 forces the oil valve 125 into a closed position in which the rubberized sealing ring 320 is pressed against the printed circuit board 115, thereby preventing oil from flowing through the hole 305. As shown in FIG. 9, when the cable-side connector assembly 105 and receptacle-side connector assembly 110 are coupled together, the molded contact receptor 530 pushes against the oil valve 125 and forces the oil valve 125 to retract, moving the rubberized sealing ring 320 away from the printed circuit board 115 and allowing oil to flow freely through the hole 305. The flow of oil through the hole 305 equalizes the pressure in the cable-side connector assembly 105 and receptacle-side connector assembly 110.

Figure 10:
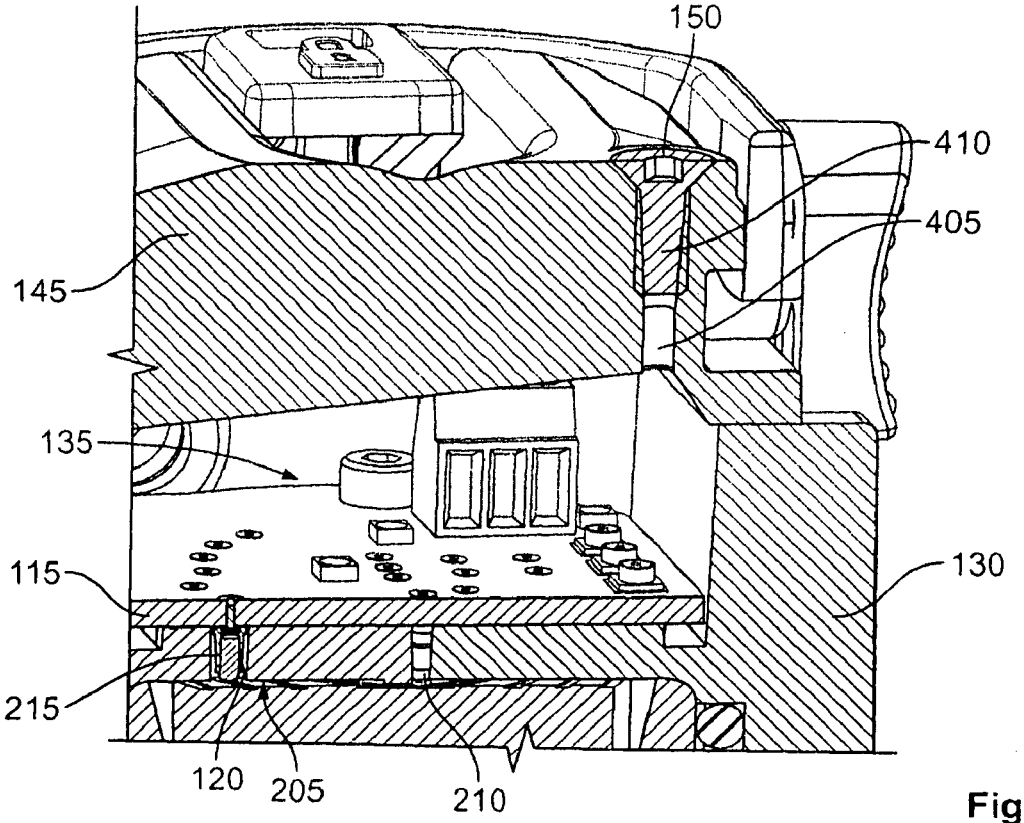
FIG. 10 is a detailed sectional view of the preferred embodiment of FIG. 1, showing the bleed valve of the submersible electrical cable connector.

With reference to FIG. 10, there is shown a detailed view of the bleed valve 150. The bleed valve 150 comprises an air chamber 405 and a countersunk screw 410 having a socket head, both located in the cap 145 of the cable-side connector assembly 105. The bleed valve 150 provides a means for removing air trapped in the submersible electrical cable connector 100. Tube 165 carries oil into the cable-side connector assembly 105. As the cable-side connector assembly 105 fills with oil, an air pocket forms in the upper part of the connector assembly. By unscrewing the countersunk screw 410, a user can remove this air pocket from the cable-side connector assembly 105.

When the submersible electrical cable connector 100 of the present invention is fully assembled, the cable-side connector assembly 105 will fit onto the receptacle-side connector assembly 110 using a lever-actuated latch assembly 170, without the need for any angular alignment of the cable-side connector assembly 105 and receptacle-side connector assembly 110. The lever-actuated latch assembly 170 ensures a proper electrical connection regardless of the angular orientations of the two connector assemblies.

In a preferred embodiment, shown in FIGS. 1-6, the lever-actuated latch assembly 170 is attached to the cable-side connector assembly 105 and engages a lipped outer edge ring 175 of the receptacle-side connector assembly 110. The latch assembly 170 comprises two side latches 180 having fly grips 182 and a semi-circular lever 185 that pivots on the cap 145 of the cable-side connector assembly 105 and actuates both of the latches 180 simultaneously. When the latch lever 185 is pivoted such that it extends outward from the cap 145 of the cable-side connector assembly 105, the two latches 180 are moved downward relative to the rest of the cable-side connector assembly 105. In this unlatched position, shown in FIGS. 3 and 4, the latches 180 are allowed to flex outward from the housing 130 of the cable-side connector assembly 105.

The flexure of the latches 180 allows the receptacle-side connector assembly 110 to be pressed onto the cable-side connector assembly 105. As the receptacle-side connector assembly 110 is pushed onto the cable-side connector assembly 105, with the latch lever 185 extending outward from the cap 145, the two latches 180 flex outward and pass over the lipped outer edge ring 175 of the receptacle-side connector assembly 110, loosely affixing the cable-side connector assembly 105 to the receptacle-side connector assembly 110 without coupling the electrical connections or allowing pressure compensating oil to flow between the two connector assemblies. The latch lever 185 is then pivoted from a position extending outward from the cap 145 of the cable-side connector assembly 105 to a position flat on top of the cap 145. As the latch lever 185 is pivoted, the two latches 180 move upward with respect to the rest of the cable-side connector assembly 105. This movement of the latches 180 pulls the cable-side connector assembly 105 and receptacle-side connector assembly together 110, compressing the pin assemblies 120 together and coupling the electrical connections between the two connector assemblies. This movement of the latches 180 also pushes the molded contact receptor 530 against the oil valve 125 and forces the oil valve 125 to retract, moving the rubberized sealing ring 320 away from the printed circuit board 115 and allowing pressure compensating oil to flow freely between the two connector assemblies through the hole 305 in the circuit board 115.

As shown in FIGS. 1-6, the housing 130 includes pair of rods 190, each rod 190 attached between a pair of flanges 191 located on opposite sides of the housing 130. In the unlatched position shown in FIGS. 3 and 4, each of the rods 190 is positioned adjacent to an indentation 192 in the latches 180, allowing the latches 180 to flex outward from the housing 130 of the cable-side connector assembly 105. In the latched position shown in FIGS. 1, 2, 5 and 6, the rods 190 are spaced from the indentations 192 and are positioned adjacent to flat sections 193 of the latches 180. In this position, the rods 190 inhibit the latches 180 from flexing outward from the housing 130 of the cable-side connector assembly 105. By inhibiting the latches 180 from flexing outward, the rods 190 ensure that the latches 180 stay engaged in the lipped outer edge ring 175 of the receptacle-side connector assembly 110.

The semicircular latch lever 185 includes a tab 195 that, in the latched position, engages a projection 196 formed in the cap 145 of the cable-side connector assembly 105. This engagement helps maintain the submersible electrical cable connector 100 in the latched position when it is underwater. Additionally, a large rubberized sealing ring 197 within the cable-side connector assembly 105 provides a water-tight seal between the cable-side connector assembly 105 and receptacle-side connector assembly 110 when the submersible electrical cable connector 100 is underwater.

Figure 11:
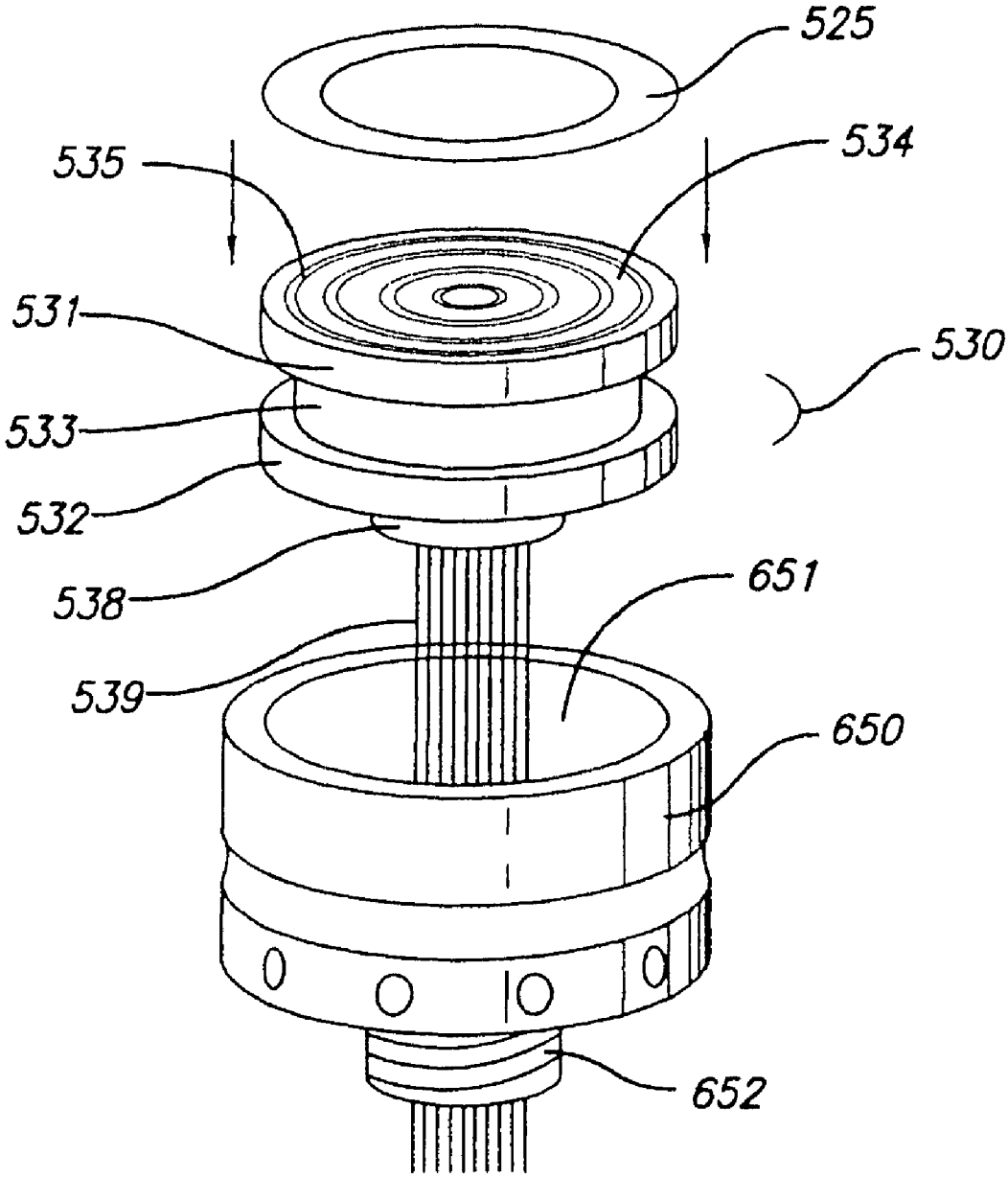
FIG. 11 is an exploded view of a preferred embodiment of a receptacle side connector assembly for the submersible electrical cable connector of the present invention.

The cable-side connector assembly 105 is configured to mate to a receptacle-side connector assembly of the type disclosed in U.S. Pat. No. 6,719,578 to Klassen et al. FIG. 11 shows one preferred embodiment of the receptacle-side connector assembly 110 for the submersible electrical cable connector 100 of the present invention. As shown in FIG. 11, the receptacle-side connector assembly 110 includes a metallic housing element 650 having a hollow interior 651 that houses the molded contact receptor 530 and an O-ring 525. The O-ring 525 provides a secure seal such that the molded contact receptor 530 fits snugly and securely within the metallic housing element 650, without any physical contact occurring between the conductive surface of the molded contact receptor 530 and the metallic housing element 650.

As further illustrated in FIG. 11, the molded contact receptor 530 is preferably cylindrical and has an upper circumference 531, a lower circumference 532, and a channel 533 therebetween for housing the O-ring 525. In one embodiment, the lower circumference 531 is slightly larger than the upper circumference 532 such that, when the cable-side connector assembly 105 and receptacle-side connector assembly 110 are coupled together, a little space is left between the interior surface of the metallic housing element 650 and the upper circumference 532. This space allows a pressure equalizing fluid, such as oil, to flow through the receptacle-side cable connector.

In a preferred embodiment, the molded contact receptor 530 has a front surface 534 and a back surface 538. The front surface 534 of the molded contact receptor 530 is comprised of a number of concentric conductive rings 535. Insulating material, such as plastic, is disposed between each conductive ring 535 and along the outer perimeter of the front surface 534 of the molded contact conductor 530. The concentric conductive rings 535 make a physical and electrical connection with the pin assemblies 120.

The back surface 538 of the molded contact receptor 530 has metallic conductive strips 539 extending therefrom. Each of the metallic conductive strips 539 is an extension of one of the concentric conductive rings 535 on the front surface 534 of the molded contact receptor 530, such that each ring 535 has an associated strip 539 extending from the back surface 538 of the molded contact conductor 530. The strips 539 and the concentric conductive rings 535 are preferably formed of a lightweight conductive metal such as copper.

The metallic housing element 650 is preferably formed of a sturdy steel alloy and has a rear screw mount 652. The rear screw mount 652 provides a channel into the interior of the metallic housing element 650. The molded contact receptor 530 is housed in the interior and the metallic conductive strips 539 extending therefrom are disposed within the channel and extend out through the rear screw mount 652. A cable or wire assembly (not shown) within the underwater device may be coupled with the rear screw mount 652 in a conventional fashion, with the individual wires within the underwater device or module being coupled to each one of the metallic conductive strips.

The foregoing description details certain preferred embodiments of the present invention and describes the best mode contemplated. It will be appreciated, however, that the invention can be practiced in many ways and is not intended to be limited or restricted in any fashion except as defined in the claims which follow, and any equivalents thereto.

What is claimed is:

1. A submersible cable connector assembly comprising:

a cable-side connector assembly comprising a printed circuit hoard having a plurality of pin assemblies protruding therefrom; and a receptacle-side connector assembly comprising a contact receptor having a plurality of concentric conducting rings with insulating material positioned between each ring;

wherein each of the plurality of pin assemblies comprises a spring and an associated pin;

wherein each pin assembly spring is configured to apply an outward force to its associated pin and urge the associated pin to make contact with one of the plurality of concentric conducting rings when the cable-side connector assembly and the receptacle-side connector assembly are coupled together; and wherein the printed circuit board further comprises an oil valve configured to allow oil to flow between the cable-side connector assembly and the receptacle-side connector assembly when the cable-side connector assembly and the receptacle-side connector assembly are coupled together.

2. The submersible cable connector assembly of claim 1, wherein the contact receptor is configured to apply an inward force to the pins of the plurality of pin assemblies and force each pin assembly spring to compress when the cable-side connector assembly and the receptacle-side connector assembly are coupled together.

3. The submersible cable connector assembly of claim 1, wherein the cable-side connector assembly and the receptacle-side connector assembly are configured to be coupled together to create an electrical connection regardless of how the cable-side connector assembly and the receptacle-side connector assembly are angularly oriented.

4. The submersible cable connector assembly of claim 1, further comprising a sealing ring located within the cable-side connector assembly and configured to provide a watertight seal between the cable-side connector assembly and the receptacle-side connector assembly when the cable-side connector assembly and the receptacle-side connector assembly are coupled together.

5. The submersible cable connector assembly of claim 1, wherein the oil valve comprises:

a valve sealing ring and a ring holder positioned on an upper side of the printed circuit board;

a valve spring and a contact head positioned on a lower side of the printed circuit board; and a shaft extending through a hole in the printed circuit board and connecting the ring holder to the contact head.

6. The submersible cable connector assembly of claim 5, wherein:

the valve spring is configured to force the oil valve into a closed position in which the valve sealing ring is pressed against the printed circuit board, thereby inhibiting oil from flowing through the hole in the printed circuit board, when the cable-side connector assembly and the receptacle-side connector assembly are not coupled together; and the contact receptor is configured to force the oil valve into an open position in which the valve sealing ring is moved away from the printed circuit hoard, thereby allowing oil to flow though the hole in the printed circuit board, when the cable-side connector assembly and the receptacle-side connector assembly are coupled together.

7. The submersible cable connector assembly of claim 1, wherein the cable-side connector assembly further comprises:

a housing defining a recess in which the printed circuit board is located;

a cap covering the recess; and a sealing ring positioned between the housing and the cap and configured to provide a watertight seal between the housing and the cap.

8. The submersible cable connector assembly of claim 7, wherein the housing includes a plurality of holes, each hole configured to allow one of the plurality of pin assemblies to extend therethrough.

9. The submersible cable connector assembly of claim 7, wherein the housing has a tubular protrusion configured to allow oil and a cable to pass into the housing.

10. The submersible cable connector assembly of claim 7, wherein the cap comprises a bleed valve configured to allow the removal of air trapped within the submersible cable connector assembly when the submersible cable connector assembly is filled with oil.

11. The submersible cable connector assembly of claim 10, wherein the bleed valve comprises:

a countersunk screw; and an air chamber located in the cap and configured to receive the countersunk screw.

12. The submersible cable connector assembly of claim 11, wherein air trapped within the submersible cable connector assembly can be removed by unscrewing the countersunk screw.

13. The submersible cable connector assembly of claim 1, further comprising a latch assembly attached to the cable-side connector assembly and configured to force the cable-side connector assembly and the receptacle-side connector assembly together to create an electrical connection.

14. The submersible cable connector assembly of claim 13, wherein the latch assembly comprises:

a latch having a fly grip; and a lever configured to pivot on the cable-side connector assembly and actuate the latch.

15. The submersible cable connector assembly of claim 14, wherein:

the fly grip is configured to apply a force to the receptacle-side connector assembly as the lever is pivoted from an unlatched position in which the lever extends outward from the cable-side connector assembly to a latched position in which the lever is flush with the cable-side connector assembly;

and the force applied by the fly grip to the receptacle-side connector assembly causes the cable-side connector assembly and receptacle-side connector assembly to be pulled together, creating an electrical connection between the cable-side connector assembly and the receptacle-side connector assembly.

16. The submersible cable connector assembly of claim 15, wherein:

the cable-side connector assembly further comprises a housing defining a pair of flanges, and a rod having a right end attached to one of the pair of flanges and a left end attached to the other one of the pair of flanges, the rod configured to inhibit the latch from flexing outward from the housing when the lever is in the latched position; and the latch further has an indentation configured to receive the rod and allow the latch to flex outward from the housing when the lever is in the unlatched position.

17. A submersible cable connector assembly comprising:

a cable-side connector assembly comprising a printed circuit board having a plurality of pin assemblies and an oil valve protruding therefrom; and a receptacle-side connector assembly comprising a contact receptor having a plurality of concentric conducting rings with insulating material positioned between each ring;

wherein each pin assembly makes contact with one of the plurality of concentric conducting rings when the cable-side connector assembly and the receptacle-side connector assembly are coupled together;

and wherein the oil valve is configured to allow oil to flow between the cable-side connector assembly and the receptacle-side connector assembly when the cable-side connector assembly and the receptacle-side connector assembly are coupled together.

18. The submersible cable connector assembly of claim 17, wherein the oil valve comprises:

a valve sealing ring and a ring holder positioned on an upper side of the printed circuit board;

a valve spring and a contact head positioned on a lower side of the printed circuit board; and a shaft extending through a hole in the printed circuit board and connecting the ring holder to the contact head.

19. The submersible cable connector assembly of claim 18, wherein the ring holder comprises an upper rim and a lower rim holding the valve sealing ring.

20. The submersible cable connector assembly of claim 18, wherein:

the valve spring is configured to force the oil valve into a closed position in which the valve sealing ring is pressed against the printed circuit board, thereby inhibiting oil from flowing through the hole in the printed circuit board, when the cable-side connector assembly and the receptacle-side connector assembly are not coupled together; and the contact receptor is configured to force the oil valve into an open position in which the valve sealing ring is moved away from the printed circuit board, thereby allowing oil to flow though the hole in the printed circuit board, when the cable-side connector assembly and the receptacle-side connector assembly are coupled together.

21. A submersible cable connector assembly comprising:

a cable-side connector assembly comprising:

a printed circuit board having a plurality of pin assemblies, a housing defining a recess in which the printed circuit board is located, a cap covering the recess, a sealing ring positioned between the housing and the cap and configured to provide a watertight seal between the housing and the cap, and a bleed valve attached to the cap; and a receptacle-side connector assembly comprising a contact receptor having a plurality of concentric conducting rings with insulating material positioned between each ring;

wherein each pin assembly makes contact with one of the plurality of concentric conducting rings when the cable-side connector assembly and the receptacle-side connector assembly are coupled together;

and wherein the bleed valve is configured to allow the removal of air trapped within the submersible cable connector assembly when the submersible cable connector assembly is filled with oil.

22. The submersible cable connector assembly of claim 21, wherein the bleed valve comprises:

a countersunk screw; and an air chamber located in the cap and configured to receive the countersunk screw.

23. The submersible cable connector assembly of claim 22, wherein the countersunk screw comprises a socket head.

24. The submersible cable connector assembly of claim 22, wherein air trapped within the submersible cable connector assembly can be removed by unscrewing the countersunk screw.

25. A submersible cable connector assembly comprising:

a cable-side connector assembly comprising a printed circuit board having a plurality of pin assemblies protruding therefrom; and a receptacle-side connector assembly comprising a contact receptor having a plurality of concentric conducting rings with insulating material positioned between each ring;

wherein each of the plurality of pin assemblies comprises a spring and an associated pin;

wherein each pin assembly spring is configured to apply an outward force to its associated pin and urge the associated pin to make contact with one of the plurality of concentric conducting rings when the cable-side connector assembly and the receptacle-side connector assembly are coupled together;

wherein the cable-side connector assembly further comprises a housing defining a recess in which the printed circuit board is located, a cap covering the recess, and a sealing ring positioned between the housing and the cap and configured to provide a watertight seal between the housing and the cap; and wherein the cap comprises a bleed valve configured to allow the removal of air trapped within the submersible cable connector assembly when the submersible cable connector assembly is filled with oil.

26. The submersible cable connector assembly of claim 25, wherein the bleed valve comprises:

a countersunk screw; and an air chamber located in the cap and configured to receive the countersunk screw.

27. The submersible cable connector assembly of claim 26, wherein air trapped within the submersible cable connector assembly can be removed by unscrewing the countersunk screw.

28. A submersible cable connector assembly comprising:

a cable-side connector assembly comprising a printed circuit board having a plurality of in assemblies protruding therefrom;

a receptacle-side connector assembly comprising a contact receptor having a plurality of concentric conducting rings with insulating material positioned between each ring; and a latch assembly attached to the cable-side connector assembly and configured to force the cable-side connector assembly and the receptacle-side connector assembly together to create an electrical connection;

wherein each of the plurality of pin assemblies comprises a spring and an associated pin;

wherein each pin assembly spring is configured to apply an outward force to its associated pin and urge the associated pin to make contact with one of the plurality of concentric conducting rings when the cable-side connector assembly and the receptacle-side connector assembly are coupled together;

wherein the latch assembly comprises a latch having a fly grip, and a lever configured to pivot on the cable-side connector assembly and actuate the latch;

wherein the fly grip is configured to apply a force to the receptacle-side connector assembly as the lever is pivoted from an unlatched position in which the lever extends outward from the cable-side connector assembly to a latched position in which the lever is flush with the cable-side connector assembly; and wherein the force applied by the fly grip to the receptacle-side connector assembly causes the cable-side connector assembly and receptacle-side connector assembly to be pulled together, creating an electrical connection between the cable-side connector assembly and the receptacle-side connector assembly.

29. The submersible cable connector assembly of claim 28, wherein:

the cable-side connector assembly further comprises a housing defining a pair of flanges, and a rod having a right end attached to one of the pair of flanges and a left end attached to the other one of the pair of flanges, the rod configured to inhibit the latch from flexing outward from the housing when the lever is in the latched position; and the latch further has an indentation configured to receive the rod and allow the latch to flex outward from the housing when the lever is in the unlatched position.

* * * * *

UNITED STATES PATENT AND TRADEMARK OFFICE

CERTIFICATE OF CORRECTION

PATENT NO. : 7,749,008 B2
APPLICATION NO. : 12/196103
DATED : July 6, 2010
INVENTOR(S) : William P. Klassen et al.

It is certified that error appears in the above-identified patent and that said Letters Patent is hereby corrected as shown below:

At column 9, line 21, "hoard" should be -- board --.
At column 10, line 12, "hoard" should be -- board --.
At column 12, line 66, "in" should be -- pin --.

Signed and Sealed this

Seventh Day of December, 2010

David J. Kappos

David J. Kappos
*Director of the United States Patent and Trademark Office*